United States Patent [19]

Cannon

[11] Patent Number: 4,690,299

[45] Date of Patent: Sep. 1, 1987

[54] BULK CARBONATED BEVERAGE CONTAINER

[75] Inventor: David C. Cannon, Darlington, S.C.

[73] Assignee: Sonoco Products Company, Hartsville, S.C.

[21] Appl. No.: 875,047

[22] Filed: Jun. 17, 1986

[51] Int. Cl.[4] ..... B65D 5/40

[52] U.S. Cl. ..... 220/402; 220/410; 220/435; 220/5 R; 229/4.5

[58] Field of Search ..... 220/403, 402, 408, 410, 220/465, 435, 83, 5 R; 229/4.5, 67

[56] References Cited

U.S. PATENT DOCUMENTS

| | | | |
|---|---|---|---|
| 2,363,352 | 10/1943 | O'Brien . | |
| 2,406,758 | 9/1946 | Gazette | 229/4.5 |
| 2,434,505 | 1/1948 | Miller . | |
| 2,467,182 | 4/1949 | Beattie . | |
| 2,522,058 | 9/1950 | Peters | 229/4.5 |
| 2,620,963 | 12/1952 | Hagopian . | |
| 2,679,336 | 5/1954 | Frick . | |
| 2,973,119 | 2/1961 | Parker | 220/402 X |
| 3,058,642 | 10/1962 | Hester . | |
| 3,116,001 | 12/1963 | Carpenter et al. . | |
| 3,143,238 | 8/1964 | Bulgrin | 220/5 R |
| 3,155,305 | 10/1964 | Bergstrom . | |
| 3,187,934 | 6/1963 | Huber . | |
| 3,348,728 | 10/1967 | Love . | |
| 3,357,626 | 12/1967 | Carpenter et al. . | |
| 3,394,388 | 7/1968 | Kuchlin . | |
| 3,409,201 | 10/1968 | Carpenter, Jr. . | |
| 3,455,049 | 7/1969 | Carpenter, Jr. . | |
| 3,472,568 | 10/1969 | Southwick . | |
| 3,487,989 | 1/1970 | Rausing et al. . | |
| 3,540,394 | 11/1970 | Ignell . | |
| 3,608,769 | 9/1971 | Gablin . | |
| 3,952,677 | 4/1976 | Hartman et al. . | |
| 4,117,951 | 10/1978 | Winckler . | |
| 4,185,758 | 2/1980 | Giggard . | |
| 4,191,305 | 4/1980 | Davis . | |
| 4,286,723 | 9/1981 | Schutz | 220/5 R |
| 4,308,973 | 1/1982 | Irland . | |
| 4,457,465 | 7/1984 | Shepard et al. . | |
| 4,585,143 | 4/1986 | Fremow et al., | 220/465 X |

*Primary Examiner*—Steven M. Pollard

*Attorney, Agent, or Firm*—Dennison, Meserole, Pollack & Scheiner

[57] ABSTRACT

A non-returnable beer keg including a pressure-retaining tubular composite body surrounded by an outwardly spaced independent rigid self-sustaining tubular metal wall. A pair of metal end caps overlie the opposed ends of the composite tubular body and are peripherally fixed to the opposed ends of the outer metal wall. A liquid impervious liner is provided interiorly within the composite body. One end cap incorporates a filling hole with an associated dispensing valve assembly. This end cap is in turn surrounded by an extension cuff fixed to the metal wall and incorporating hand holes therein.

1 Claim, 4 Drawing Figures

BULK CARBONATED BEVERAGE CONTAINER

BACKGROUND OF THE INVENTION

Bulk carbonated beverage containers, and specifically beer kegs, are commonly in the nature of returnable containers. That is, after the contents are dispensed, the container is returned for reuse.

The use of non-returnable beer kegs has been proposed for several reasons, including the elimination of the expenses and difficulties in returning the empty reusable kegs, the avoidance of the necessity of clean and resterilize the kegs prior to reuse, and a substantial reduction in the cost of the individual kegs which, as a single-use item, will be subjected to far less handling and structural abuse as compared to the conventinal returnable keg.

While several attempts have been made to produce a viable non-returnable keg of sufficient structural integrity and practical low cost to both secure the product and make it practical to dispose of the keg after a single use, such attempts have met with little success.

Two examples of existing non-returnable beer kegs include a keg of all epoxy coated steel, and a bag consisting of a polyethylene terephthalates bottle reinforced with an external paper tube. However, while the structural integrity of such products are generally adequate for a single use item, the cost of the kegs, as compared to the cost of a returnable keg, is too great to be economically feasible.

Basically, not only must a non-returnable or single-use beer keg be inexpensive, because of the particular nature of the goods to be stored therein, it must be liquid-tight, capable of sustaining internal pressure of at least 60 psi, and possibly as great as 120 psi, without distortion or rupture, and must be capable of resisting damage from external forces during the rough handling to which such kegs are frequently subjected.

SUMMARY OF THE INVENTION

The container construction of the present invention is uniquely adaptable for single use as a non-returnable keg for containing pressurized liquids, particularly beer, within a sterile environment for selective dispensing in the manner of a conventional keg. The keg of the invention is economically feasible as a non-returnable item with the materials costs thereof being minimal and substantially less than in both returnable kegs and known non-returnable kegs.

Notwithstanding the inexpensive nature of the keg construction contemplated in the present invention and particular economies in use attributable thereto, the formed keg is a structurally secure container capable of accommodating both internal pressures and such external forces as might be expected in the normal handling thereof without affecting the integrity of the container.

The non-returnable keg of the invention is formed with a tubular composite body having an outer protective tubular metal sleeve or wall thereabout size to provide for an intermediate space therebetween. The opposed ends of the metal sleeve are rigid with a pair of opposed end walls or end caps which overlie the opposed ends of the composite body. The composite body, in turn, is provided with an internal liquid impervious liner.

The composite body is formed, in the manner of a conventional composite tube, of multiple spirally wrapped plies of paper, or paper-like or fiber material bonded together to define a unitary member of sufficient strength to effectively resist the radial component of internally generated pressure with minimal expansion or distortion, and at the same time provide for sufficient strength to allow for keg stacking and such handling as might be normally anticipated.

The outer metal sleeve is independent of the composite body and provides a rigid self-sustaining wall which retains the end caps against the axial component of the internally generated pressure. The end caps, of a relatively heavier metal, are normally domed for extra strength, with one of the caps provided with an appropriate filler and dispensing valve assembly.

The internal space defined between the composite body and the metal sleeve is of significance in that this space will accommodate any minor outward expansion of the composite body, as a result of the internal pressure, without distortion of the outer sleeve, and thus without affecting the external appearance of the keg. The sleeve, in turn, will protect the composite body against scratches, scores or the like which could damage the strength-providing composite tube.

The composite tube, particularly upon a slight pressure-responsive expansion thereof, will tend to back-up the metal sleeve for a stabilization thereof without distortion. The metal sleeve, in turn, will present an external appearance of a strong metal keg, notwithstanding the relatively thin nature thereof which, while of a sufficient tensile strength to retain the end caps, relies on the internally concealed composite tube for keg strength and stability.

The actual retention of the beer, or other pressurized liquid, is achieved by an internal impervious liner which can be an inner bag sealed at the end cap valve, or alternatively a film, laminate or coating about the inner face of the composite tubular body appropriately sealed to similar coatings or the like provided on the inner surfaces of the end caps to define the desired liquid impervious internal chamber.

Constructed as above, the external metal sleeve, and for that matter the composite body, never comes in contact with the contents of the keg. As such, less expensive materials and simplified procedures regarding filling and sterilization can be used. For example, the use of sterile interior bags, which in each instance will be thrown away with the keg after single usage, will eliminate the necessity for a separate sterilization step during the filling procedure. Similarly, the metal sleeve, as well as the end caps, can be formed of steel with galvanized or other coatings to reduce costs and improve weatherability without restrictions relating to food compatibility.

Additional objects and advantages will become obvious from the following detailed description of the construction and manner of use of the invention.

DESCRIPTION OF PREFERRED EMBODIMENTS

Figure 1:
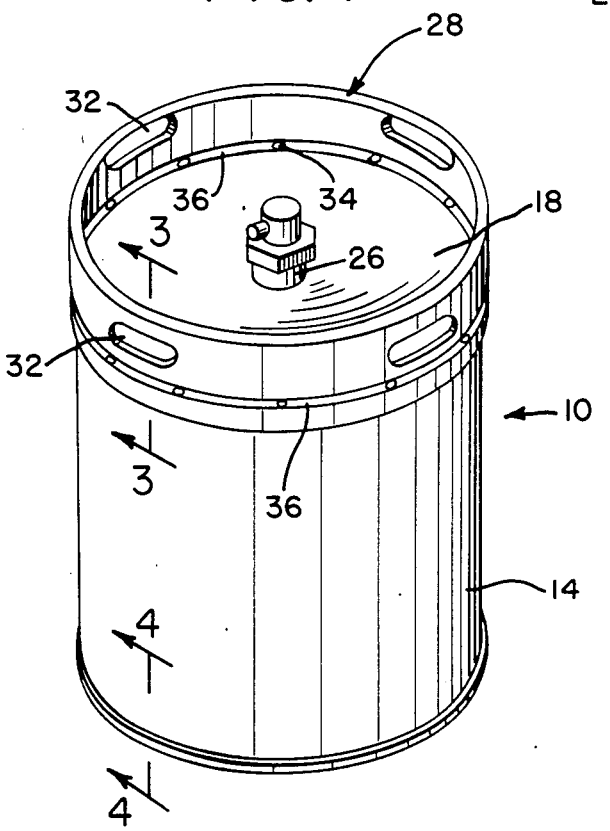
FIG. 1 is a perspective view of a bulk carbonated beverage container constructed in accord with the present invention.
Figure 3:
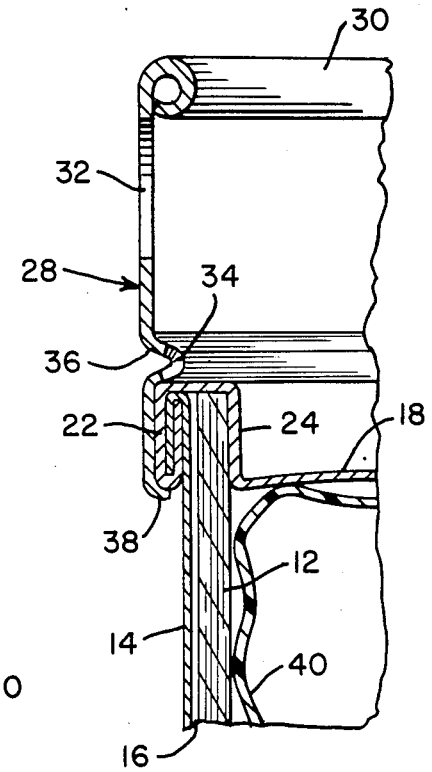
FIG. 3 is an enlarged cross-sectional detail taken substantially on a plane passing along line 3—3 in FIG. 1.
Figure 4:
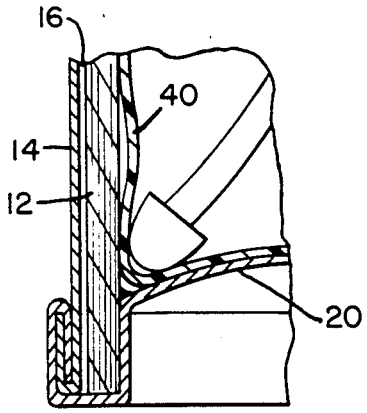
FIG. 4 is an enlarged cross-sectional detail taken substantially on a plane passing along line 4—4 in FIG. 1.
Figure 2:
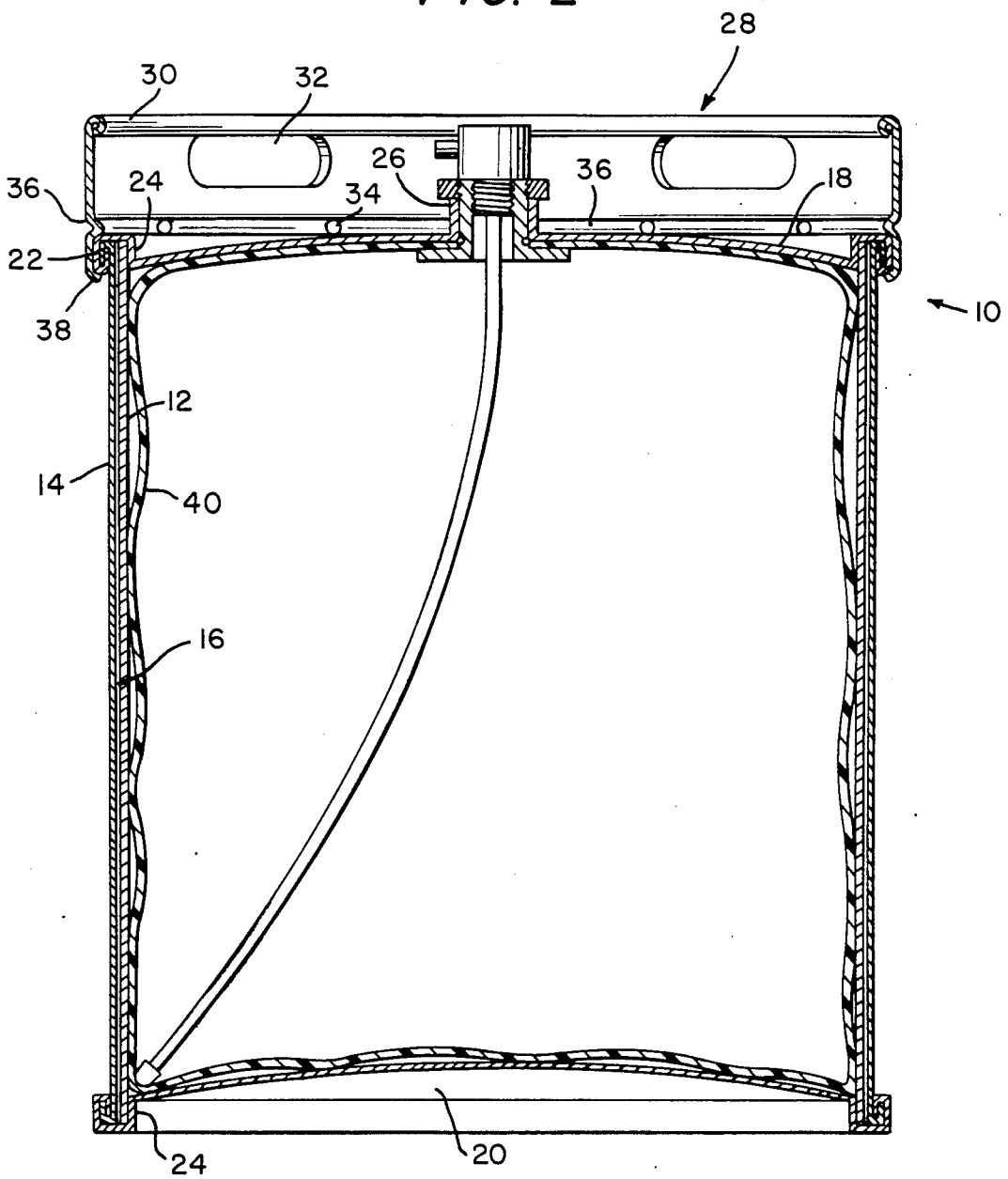
FIG. 2 is a vertical cross-sectional view through the container of FIG. 1.

Referring now more specifically to the drawings, the beer keg, or more generally the bulk carbonated beverage container of the invention is generally designated by reference numeral 10. It is particularly intended that the keg 10 be of a stable relatively high-strength construction for the packaging, shipping and dispensing of bulk pressurized liquids in the manner of a conventional beer keg. In conjunction therewith, the keg 10, as proposed herein, is constructed of low cost materials structurally interrelated in a manner to achieve the desired strength and stability at a minimal cost, allowing use of the keg as a non-returnable item and the avoidance of the expenses normally associated with the return, resterilization, etc. of the conventional returnable keg.

Basically, the keg 10 includes an inner strength providing body 12 defined by a composite tube, that is a tube of bonded multiple spirally wrapped plies of paper or the like. Such composite tubes are generally conventional in the container art and provide a stable body construction with stacking strength.

The composite tubular body 12 is surrounded by an outer metal sleeve 14 of, as an example, galvanized steel. The inside diameter of the sleeve 14 is greater than the outside diameter of the composite body 12 whereby an annular space 16 is defined therebetween for accommodation of pressure induced expansion of the composite body 12 without distortion of the external sleeve 14, as shall be explained subsequently.

The opposed ends of the keg 10 are closed by upper and lower end caps or end walls 18 and 20, each enclosing the corresponding open end of the composite body 12 and being appropriately fixedly joined to the corresponding end of the outer metal sleeve 14 as illustrated at 22. This joinder between the end walls and the sleeve ends, while illustrated as a rolled seam, can be effected in any manner conventional in the metal container art to provide a permanent joinder peripherally about the sleeve end and preferably continuously sealed. As illustrated, a slight chime 24 is defined about each end of the container 10 with the end caps 18 and 20 extending into the opposed ends of the body 12 and respectively outwardly and inwardly doming. As desired, the configuration of the end caps, that is whether planar or outwardly or inwardly domed, can vary as dictated by appearance, internal pressure, or other design criteria.

The top end cap 18 will normally incorporate an appropriate filler neck and valve assembly 26 sealed thereto and communicating with the interior of the container in a generally conventional manner for the introduction and subsequent discharge of liquid in a controlled manner.

In order to facilitate handling of the keg, normally of a size to accommodate 50 liters of beer or the like, an annular cuff extension 28 will be provided about and affixed to the upper end of the container 10. The cuff, formed of sheet metal with a rolled upper edge 30, will incorporate appropriate hand holes 32 to facilitate handling of the keg, and drain holes 34 about and immediately above the keg chime 24. As will be appreciated, the cuff 28 is of a height greater than the valve assembly 26 to provide a protective wall thereabout.

While the metal cuff 28 can be affixed to the chime 24 or seam 22 in any appropriate manner, such as by welding, a preferred manner has been illustrated wherein an annular inwardly directed rib 36 on the cuff engages and overlies the upper edge of the keg chime 24 completely thereabout. The lower annular edge portion 38 of the cuff 28 is in turn rolled into retaining engagement beneath the seam 22, thereby effectively locking the cuff to the keg without the necessity of spot welding or the use of adhesives. Such an interlocking of the cuff to the keg is particularly desirable when using inexpensive galvanized steel in that welding damage to the surface of the galvanized steel is avoided.

In order to render the inner composite body 12 impervious to liquid, an internal liner, coating, bag or the like will be provided. The container 10, for purposes of illustration, has been shown with an internal liquid impervious bag 40 which, as an example, may be a multilayered plastic film bag with the mouth thereof sealed to and about the valve assembly for the selective introduction and withdrawal of liquid directly to and from the bag interior. The bag 40, as will be appreciated, will intimately conform to the interior of the container and not itself be required to resist internal pressure, the generated forces of which are directly transferred to the bag engaged structural components of the container, including the tubular composite body 12 and the end caps 18 and 20.

As an alternative to the illustrated bag, the composite body 12 can be provided with an internal coating, liner, laminate or the like which will in turn be sealed to a similar liquid impervious coating on the end caps 18 and 20 to again provide a sealed liquid impervious interior. Other possibilities for precluding migration of the pressurized liquid through the normally porous composite body 12 are also contemplated, including a treating of the tube body 12 itself for liquid resistance.

The various components of the keg 10 are individually and jointly so inexpensive as to make single use of the keg feasible. Further, the interrelationship of the keg components is such whereby a highly stable pressurized liquid container, both attractive and the general equivalent of a conventional returnable beer keg, is provided.

The tubular composite body 12 will provide the basic strength and structural stability, while the outwardly spaced outer metal sleeve 14 will provide a protective wall about the relatively softer composite body to prevent scratching, scarring or the like which might both disfigure and weaken the composite body 12. The actual space defined between the composite body and the surrounding metal wall-forming sleeve 14 is significant in that the composite body 12 will tend to slightly radially expand under the internal pressure within the container. This expansion, while not affecting the strength or structural stability of the composite body 12, will tend to affect the appearance thereof, a commercially undesirable feature. Such a slight distortion, were the metal sleeve 14 intimately engaged against the composite body 12, would result in a similar outward bulging in the resiliently flexible sleeve 14. This is avoided by providing for an annulus or space-defining difference between the internal diameter of the sleeve 14 and the external diameter of the body 12. It is contemplated that the actual space defined be related to the proposed internal pressure and the anticipated expansion of the composite body so as to not only accommodate the expansion, but also, preferably, to allow expansion of the tubular body 12 into intimate, non-distorting engagement with the sleeve to provide a strengthening back-up for the sleeve without imposing a sleeve distorting pressure thereon.

The metal sleeve 14 also provides a significant function in securing the opposed end walls or end caps 18 and 20 against axial extension, resisting the axial or longitudinal component of the internal pressure. The metal sleeve 14, while relatively thin, is nevertheless substantially thicker than a foil or film, and is in fact an independent rigid self-sustaining wall with an inherent material and tensile strength sufficient to retain the opposed end caps upon being appropriately seamed, welded, or otherwise affixed thereto.

Formed in the above manner, reliance is had on the composite tubular body for the basic strength of the keg while avoiding the necessity of attempting to provide an adequate interengagement between the metal end caps and the composite body sufficient to resist substantial internal pressures. To the contrary, such axial pressures are effectively resisted by a direct engagement of the metal end caps with the body-surrounding outer thin metal wall which is, in turn, protected against radial pressures by the composite body. Incidentally, another advantage derived from the space-defining difference between the internal diameter of the metal sleeve 14 and the external diameter of the composite body 12 is the ease with which the tube members can be telescopically assembled.

It is preferred that the engagement, by seaming or otherwise, between the external metal wall or sleeve 14 and the opposed end walls or caps 18 and 20 be sealed to weatherproof the keg, and in particular the composite body thereof. This will maintain the structural integrity of the composite body and the strength derived therefrom. The container itself is completed by the liquid impervious internal liner which, in the illustrated example, is a multi-layer bag adapted to intimately contact the interior of the container, including the interior of the tubular composite body and the interior of the opposed end caps upon the introduction of the pressurized liquid.

Other liquid impervious liners, coatings, or the like may be utilized with appropriate seals sealants, or the like at the junctures between the composite body end portions and the end caps to preclude any possibility of leakage into the composite body itself, even under pressurized conditions.

While not specifically limited thereto, assuming a 50 liter keg with an internal pressure of 60 psi up to as much as 120 psi, the multi-layer spirally wrapped composite body can have a thickness of approximately 0.250". The outer metal sleeve can be approximately 28 to 30 gauge, or of a thickness generally of 0.011" to 0.015". However, thicknesses as little as 0.006" are also feasible. The spacing provided between the composite body 12 and the metal wall 14 will be determined by the anticipated radial expansion of the composite body in response to a predetermined pressure. For example, assuming a composite paper tube with a wall thickness of 0.250" and an internal pressure of 60 psi, a diametric expansion of 0.034" can be anticipated. Thus, a spacing to accomodate this expansion is preferred. While, ideally, such a spacing would be provided by an equal width annulus of approximately 0.017" completely about the container between the composite body and metal wall, as a practical matter, in the assembly of the components, the width of the space will in all probability vary about the circumference of the container with the pressure-induced expansion of the composite body centering the body within the greater diameter sleeve and equalizing any residual non-distorting pressure thereagainst peripherally thereabout.

The metal end caps or end walls, generally domed inward or outward for increased rigidity, will normally be of a thickness of approximately 0.030" to 0.063" for pressure of 60 psi or greater.

The foregoing is illustrative of the principles of the invention wherein a non-returnable beer keg has been disclosed which is both economically feasible for single use, and structurally stable for the accommodation of pressurized beer or the like in bulk. The basic strength and structural stability of the keg are provided for by a tubular composite body which is in turn enclosed within and protected by an outer metal sleeve sufficiently spaced from the composite body to accommodate inherent radial expansion of the composite body without distortion of the metal sleeve. The metal sleeve in turn protects and waterproofs the composite body and gives the appearance of a high strength metal keg, without the expense incident to the conventional returnable metal keg.

Variations in the disclosed embodiments, for example variations in the manner of securing the external metal sleeve to the end caps, or the manner of forming the metal sleeve itself, that is with seamed, butted, lapped or like longitudinal edges, and the manner in which a liquid impervious liner is provided within the container, are all contemplated within the scope of the invention.

I claim:

1. In a container for pressurized liquids a tubular composite body of sufficient structural integrity to independently accommodate pressurized liquids therein with minimal radial expansion, a similarly configured independent self-sustaining tubular metal wall surrounding said body, said tubular wall having an inside diameter greater than the outside diameter of said composite body and defining a continuous annular space therebetween sufficient for the accommodation of pressure-induced radial expansion of the composite body equally thereabout and independently of said tubular wall, the relationship between the defined annular space and the anticipated pressure-induced expansion of the composite body being such as to accommodate the expansion, up to intimate engagement with said tubular wall, without imposing a wall distorting pressure on said tubular wall, said composite body and said tubular wall having opposed ends with the ends of the composite body and the ends of the tubular wall being generally coextensive, and a pair of container end caps overlying the opposed ends of the composite body and peripherally joining the opposed ends of the tubular wall for an axial retention of said end caps, said end caps extending into the opposed ends of the composite body and being exposed to internal pressure within said container with the joining to the tubular wall and the tensile strength of the tubular wall being sufficient to resist said pressure.

* * * * *